US011878846B2

(12) United States Patent
Cox et al.

(10) Patent No.: US 11,878,846 B2
(45) Date of Patent: Jan. 23, 2024

(54) PACKAGING WITH FLOATING BAND

(71) Applicant: Apple Inc., Cupertino, CA (US)

(72) Inventors: Heather W. Cox, Los Angeles, CA (US); Fernie A. Apodaca, Thousand Oaks, CA (US); Vincenzo O. Giuliani, Thousand Oaks, CA (US); Laura Moffitt, Los Angeles, CA (US)

(73) Assignee: Apple Inc., Cupertino, CA (US)

( * ) Notice: Subject to any disclaimer, the term of this patent is extended or adjusted under 35 U.S.C. 154(b) by 7 days.

(21) Appl. No.: 17/582,865

(22) Filed: Jan. 24, 2022

(65) Prior Publication Data

US 2023/0234749 A1 Jul. 27, 2023

(51) Int. Cl.
*B65D 5/64* (2006.01)
*B65D 85/30* (2006.01)
*B65D 5/42* (2006.01)

(52) U.S. Cl.
CPC ..... *B65D 5/643* (2013.01); *B65D 5/4262* (2013.01); *B65D 85/30* (2013.01)

(58) Field of Classification Search
CPC ..... B65D 5/643; B65D 5/321; B65D 5/326–328; B65D 5/4262; B65D 71/50; B65D 71/06; B65D 2571/00067; B65D 5/445; B65D 5/443; B65D 5/68; B65D 85/30
See application file for complete search history.

(56) References Cited

U.S. PATENT DOCUMENTS 2,318,677 A * 5/1943 Delson ..... A45C 1/06 150/149
2,527,705 A * 10/1950 Crary ..... B65D 5/302 229/117.26
2,822,970 A * 2/1958 Froggatt ..... B65D 5/62 493/111
4,017,016 A * 4/1977 Ivy ..... B65D 5/326 229/122.27
5,219,116 A * 6/1993 Hearne ..... B65D 5/6664 229/125.37
5,507,429 A * 4/1996 Arlin ..... B65D 55/06 53/399
5,732,822 A * 3/1998 Mitsuyama ..... E05B 73/0023 206/387.11
6,494,336 B1 * 12/2002 Bylo ..... B65D 25/2897 220/23.6
D722,870 S * 2/2015 Fohner ..... D9/432
9,981,788 B2 * 5/2018 Skinner ..... B65D 5/38
11,072,453 B2 * 7/2021 Whitehurst ..... B65D 5/326
2007/0039849 A1 * 2/2007 Rodriguez ..... B65D 5/4262 206/457

FOREIGN PATENT DOCUMENTS

GB 2434617 A * 8/2007 ..... B65D 5/4262
KR 101914124 B1 * 2/2013

* cited by examiner

*Primary Examiner* — Nathan J Newhouse
*Assistant Examiner* — Phillip D Schmidt
(74) *Attorney, Agent, or Firm* — Sterne, Kessler, Goldstein & Fox P.L.L.C.

(57) ABSTRACT

Packaging may include a front box having a cavity to receive a product, a rear box coupled to the front box in a closed position, and a floating band to be slid around the front box and the rear box, thereby maintaining the front and rear box in a closed configuration. The band may be positioned with features such as folded protrusions with corresponding folded protrusions provided on the front box or the rear box.

20 Claims, 6 Drawing Sheets

PACKAGING WITH FLOATING BAND

FIELD

The described embodiments relate generally to packaging. More particularly, the present embodiments relate to packaging having a front box and a rear box coupled with a band that appears floating around the packaging and resists downward movement during storage and shipping. The packaging may be made of paper or other recyclable materials that may be otherwise cellulose-fiber based.

BACKGROUND

The described embodiments relate generally to packaging, including packaging that includes an interesting product display element when closed, while maintaining recyclability. Product packaging is an integral part of a customer's experience. It introduces the customer to their product, and can affect the customer's feelings toward the product and the company that created it.

In some situations, finished goods packaging does no more than hold a product, such that an opportunity to further enhance customer experience may be missed. In some instances, bands may be used around packaging to couple two sides of a box together, for example, or to further enhance branding opportunities or the aesthetic of the finished goods packaging. Moreover, many current finished goods packaging contains elements that are not single stream recyclable friendly, must instead be broken down into the constituent parts prior to recycling, rather than simply placed separately into the recycling stream.

What is needed is a packaging paradigm that can improving the customer experience in receiving products or finished goods packaging containing a product, particularly with a band disposed around a package.

SUMMARY

Some embodiments relate to packaging, including a front box, a rear box configured to close the front box and together enclose a product within the packaging, and a band configured to slide around the front and rear box, thereby maintaining the front and rear box in a closed configuration.

In some embodiments, the band includes a stopper configured to engage a feature of the front box or the rear box such that the travel of the band is limited along a vertical axis of the packaging. In some embodiments, the stopper includes a protrusion formed of paper. In some embodiments, the protrusion is c-shaped, and is attached to the band via tabs attached to the band.

In some embodiments, together the front box and the rear box define a channel through which the protrusion translates when being slid around the front and rear box, thereby maintaining the orientation of the band. In some embodiments, the front box includes the feature that engages the stopper. In some embodiments, the feature is a protrusion formed of paper and is covered by the band.

In some embodiments, the band has a height along the vertical axis of the packaging, and the stopper is disposed closer to the top edge of the band than it is to the bottom edge of the band such that when the band engages with the feature of the front box or the rear box, the stopper is not visible. In some embodiments, the front box includes the feature that engages the stopper, and wherein the feature is a protrusion beginning below the midpoint of the height of the front box, such that the band is centered on the packaging when the packaging is closed and the stopper is in contact with the feature. In some embodiments, the stopper includes a c-shaped protrusion formed of paper.

In some embodiments, the stopper includes a detent formed from the band and engages a corresponding feature on the packaging. A packaged product may include packaging described herein and a product disposed within the packaging. In some embodiments, the product is an electronic device.

Some embodiments relate to packaging, including a box. In some embodiments, the box includes side panels, top and bottom panels, and an inset panel providing space for a channel when the box is closed. The packaging includes a band in some embodiments. In some embodiments, the band includes a stopper configured to engage a feature within the channel such that travel of the band is limited along a vertical axis of the packaging. In some embodiments, the box includes a lid. In some embodiments, the feature within the channel includes a protrusion formed from paper.

In some embodiments, the feature within the channel releasably locks with the stopper. In some embodiments, the band is configured such that a user may actuate the band to unlock the feature and remove the band from the packaging. A packaged product may include packaging described herein and a product disposed within the packaging. In some embodiments the product is an electronic device.

Some embodiments relate to packaging including a front box. In some embodiments, the front box includes a front panel, a side panel, an inset panel disposed inward from the side panel and extending in a direction away from the front panel, and a folded protrusion extending from an intersection of the side panel and the inset panel. The packaging includes a rear box in some embodiments. In some embodiments, the rear box is configured to close the front box by receiving the inset panel in a cavity. In some embodiments, the inset panel forms an exterior channel between the front box and the rear box when the packaging is closed. The packaging includes a band in some embodiments. In some embodiments, the band is formed and configured to slide around the front and rear box.

In some embodiments, the band includes a folded protrusion configured to engage the folded protrusion of the front box when the band is slid around the front and rear box, thereby fixing a minimum vertical distance between the lower edge of the band and a bottom surface of the packaging. In some embodiments, the minimum vertical distance between the lower edge of the band and a bottom surface of the packaging is less than 50% of the height of the packaging. In some embodiments, the minimum vertical distance between the lower edge of the band and a bottom surface of the packaging is greater than 50% of the height of the packaging. In some embodiments, the minimum vertical distance between the lower edge of the band and a bottom surface of the packaging is 50% of the height of the packaging.

BRIEF DESCRIPTION OF THE DRAWINGS

The disclosure will be readily understood by the following detailed description in conjunction with the accompanying drawings, wherein like reference numerals designate like structural elements, and in which.

DETAILED DESCRIPTION

Figure 1:
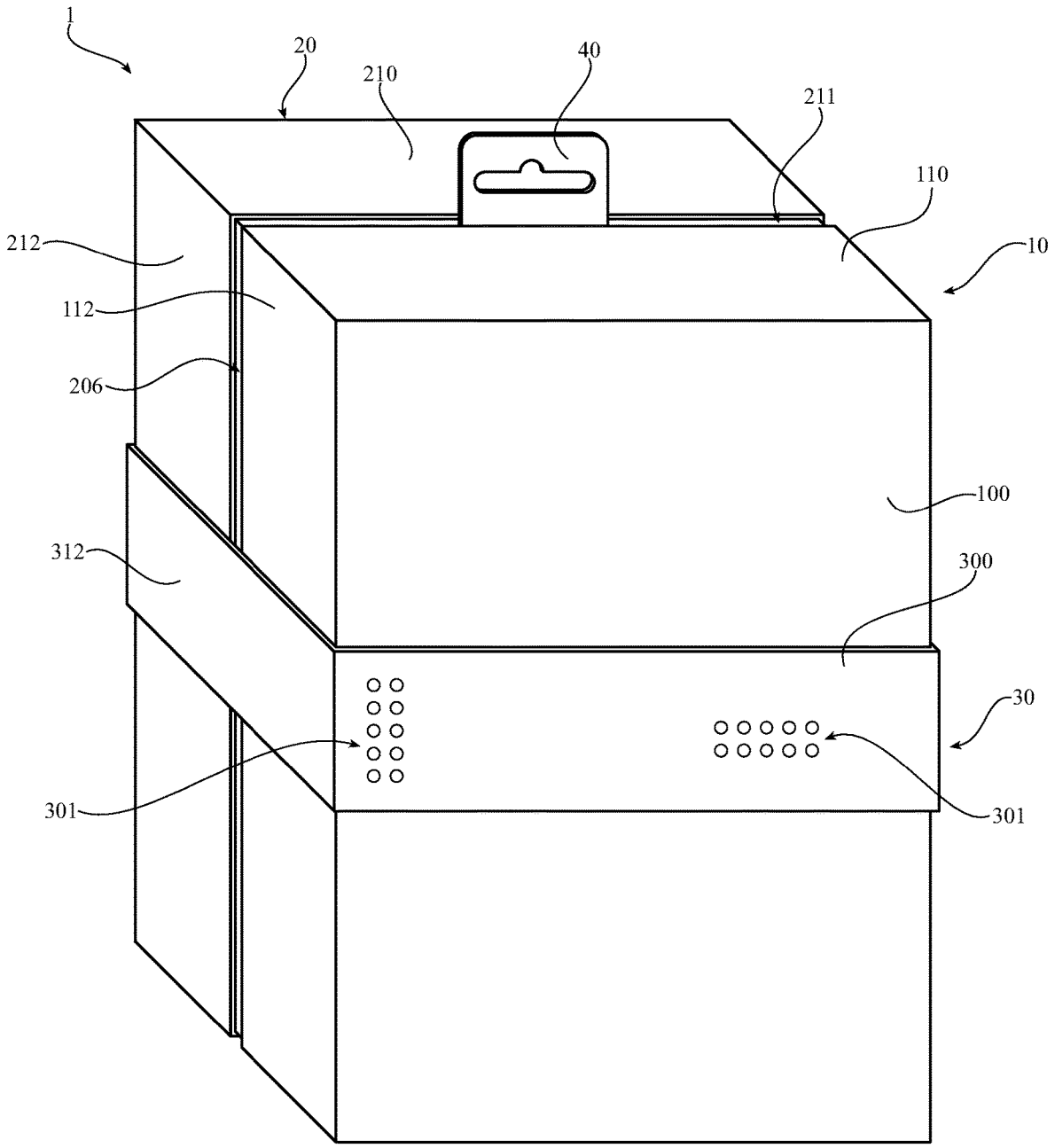
FIG. 1 shows a perspective view of packaging in an embodiment in a closed configuration.

Reference will now be made in detail to representative embodiments illustrated in the accompanying drawings. It should be understood that the following descriptions are not intended to limit the embodiments to one preferred embodiment. To the contrary, it is intended to cover alternatives, modifications, and equivalents as can be included within the spirit and scope of the described embodiments as defined by the appended claims.

The packaging described herein provides a packaging solution utilizing environmentally friendly materials and allows for a packaging solution that includes a consistent, floating band appearance until a user desires to remove the band, while retaining a high degree of recyclability. Elements are described that achieve a structurally sound package, while allowing an end user to easily recycle the package, while providing a consistent and uniform appearance for each of the packages in a given product line or family.

As above, the present embodiments relate to packaging having a front box and a rear box coupled with a band that appears floating around the packaging. In some instances, the placement of prior bands relative to packaging is inconsistent, and may shift during shipment or during the time period when a product is not yet purchased, leading to an inconsistent industrial design across the same product or product family. However, here, the band and/or front box and/or rear box may be constructed with stoppers such that a placement of the band relative to the packaging is consistent and does not shift during shipment or during the time period when a product is not yet purchased. The stoppers may be formed as protrusions, e.g., folded paper protrusions. In some embodiments, the stoppers may be formed as detents and corresponding features. The packaging may be made of paper or other recyclable materials that may be otherwise cellulose-fiber based.

As used herein, "front box" and "rear box" may refer to portions of a box that are not necessarily in a horizontal configuration, but rather may be displayed in a vertical orientation with the band circumscribing a vertical axis of the packaging. Thus, the front box and rear box may form halves of a package that if not for the band being disposed around the package the front box and rear box may be separated along a horizontal axis of the packaging. In use, a user may opt to set the front box's front panel on a horizontal surface such that the rear box may be lifted (or vice versa), e.g., as a "lid." In some embodiments, the front or rear box may not be fully separable from the other, such that a hinged lid is provided instead. However, in that configuration, the band still may be positioned via stoppers such that the band's consistent positioning is maintained until the user wishes to remove the band from the packaging.

Some embodiments include packaging including a front box formed of cardboard, e.g., paperboard or cardboard corrugate (other environmentally friendly recyclable materials are also envisioned). In some embodiments, each of the front box or rear box or both may be formed from a continuous sheet (e.g., a cardboard blank). In an embodiment, a single blank may be used to fold the entire packaging into a usable configuration except for the band. In some embodiments, the front box and rear box may be formed from separate blanks, and the band also formed separately. The respective elements may be formed of the same material or different materials that are recyclable in the same fiber-recycling stream.

Companies may be sensitive to the cost of packaging and may wish to promote packaging that is eco-friendly. Packaging made out of recyclable and/or biodegradable materials, such as paper (e.g., cardboard) can reduce environmental impact, especially when it replaces a non-recyclable element. Packaging that is interesting in character and well-executed may boost a product's or a brand's reputation, thereby attracting new customers and retaining previous customers. For example, interactive elements that present a product in an interesting way when packaging is opened, e.g., lifting a band up from around the package to allow a front box and a rear box to be opened, welcoming the customer to their product, may enhance the customer experience. Packaging described in this document achieves these and other beneficial characteristics by balancing structural robustness, eco-friendly materials, and aesthetic elements. A product contained by the packaging may be, for example, an electronic device such as, for example, headphones, a desktop computer, monitor, laptop, tablet computer, smartphone, or smart watch, or it may be a non-electronic device. The product may also be within separate finished goods packaging, such that in some instances the packaging described herein includes additional internal packaging.

These and other embodiments are discussed below with reference to the accompanying figures. However, those skilled in the art will readily appreciate that the detailed description given herein with respect to these figures is for explanatory purposes only and should not be construed as limiting.

FIG. 1 shows a front-top perspective view of packaging 1, in a closed configuration. Packaging 1 includes a front box 10 having a front panel 100, top and bottom panels 110, and side panels 112. Packaging 1 also includes a rear box 20 configured to couple to front box 10. Rear box 20 includes top and bottom panels 210, side panels 212, and rear panel 200. Rear box 20 also includes a cavity 211 that is shown in a closed relationship with front box 10 in FIG. 1. An external channel 206 is formed between front box 10 and rear box 20.

A band 30 is shown around packaging 1, effectively coupling front box 10 and rear box 20 together in a closed configuration via front and rear panels 300, and side panels 312. In some embodiments, a graphic or tactile pattern (e.g., deboss pattern 301) may be applied to band 30, front box 10, or rear box 20. Band 30 may be formed as a continuous band, and may be sized such that it closely fits around the dimensions of the side perimeter of packaging 1, when front box 10 and rear box 20 are closed.

A hang-tab 40 is shown coupled to front box 10, such that the packaging may be hung for display in a retail setting, for example. In some embodiments, hang-tab 40 is coupled to rear box 20.

Figure 2:
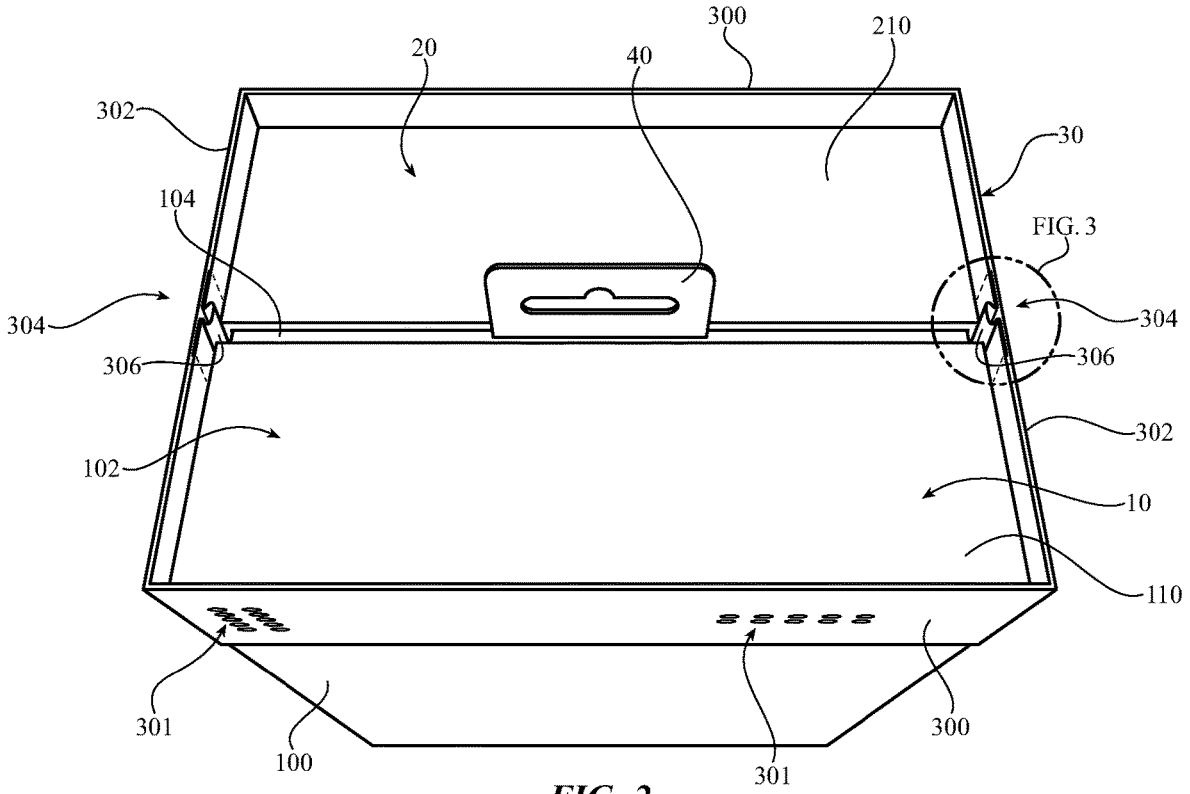
FIG. 2 shows the packaging shown in FIG. 1 as the band lifts off of the front box and rear box.
Figure 3:
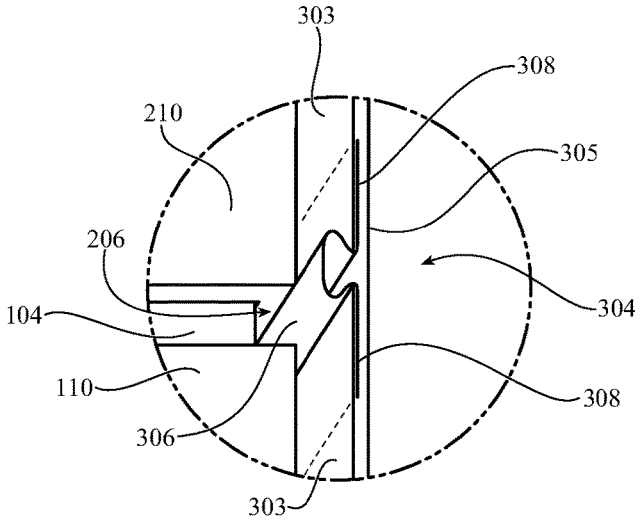
FIG. 3 shows an enlarged view of the band as it lifts off of the front box and rear box as shown FIG. 2.

Turning to FIGS. 2 and 3, packaging 1 is shown as band 30 lifts off of front box 10 and rear box 20. As shown in the figures, band 30 further includes stoppers 304, protruding from panels 302. In some embodiments, stoppers 304 may be formed from paper, and be fixed within band 30 via a first panel 305 and second panel 303, as shown in FIG. 3. For example, as shown, tabs 308 of stoppers 304 may be disposed (e.g., adhered) between layers of band 30 formed by first panel 305 and second panel 303. Second panel 303 may be integrally formed with first panel 305, or the panels may be formed from separate layers, e.g., in multiple blanks. As shown in the figures, stopper 304 includes a protrusion 306, which may be, for example, "c-shaped." In this way, stoppers 304 can fit within channel 206 to prevent band 30 from sliding down packaging 1 (e.g., when stoppers 304 encounter counterpart stoppers of front box 10 or rear box 20, such as protrusions 105 described below), and provide a single direction by which band 30 may be removed from front box 10 and rear box 20. Protrusion 306 translates through a channel formed in packaging 1 in some embodiments, e.g., when being slid around the front box 10 and rear box 20. In this way, the orientation of band 30 is maintained.

Aside from the stoppers, band 30 may not be fixed to front box 10, or rear box 20. For example, in some embodiments, there is no adhesive or other mechanical connection between the boxes and the band. Band 30 is configured to slide around front box 10 and rear box 20, thereby maintaining the front and rear box in a closed configuration, e.g., closing packaging 1. In general, band 30's stopper is configured to engage a feature of the front box 10 and/or the rear box 20 (or lid in some embodiments) such that the travel of the band is limited along a vertical axis of the packaging.

Figure 4:
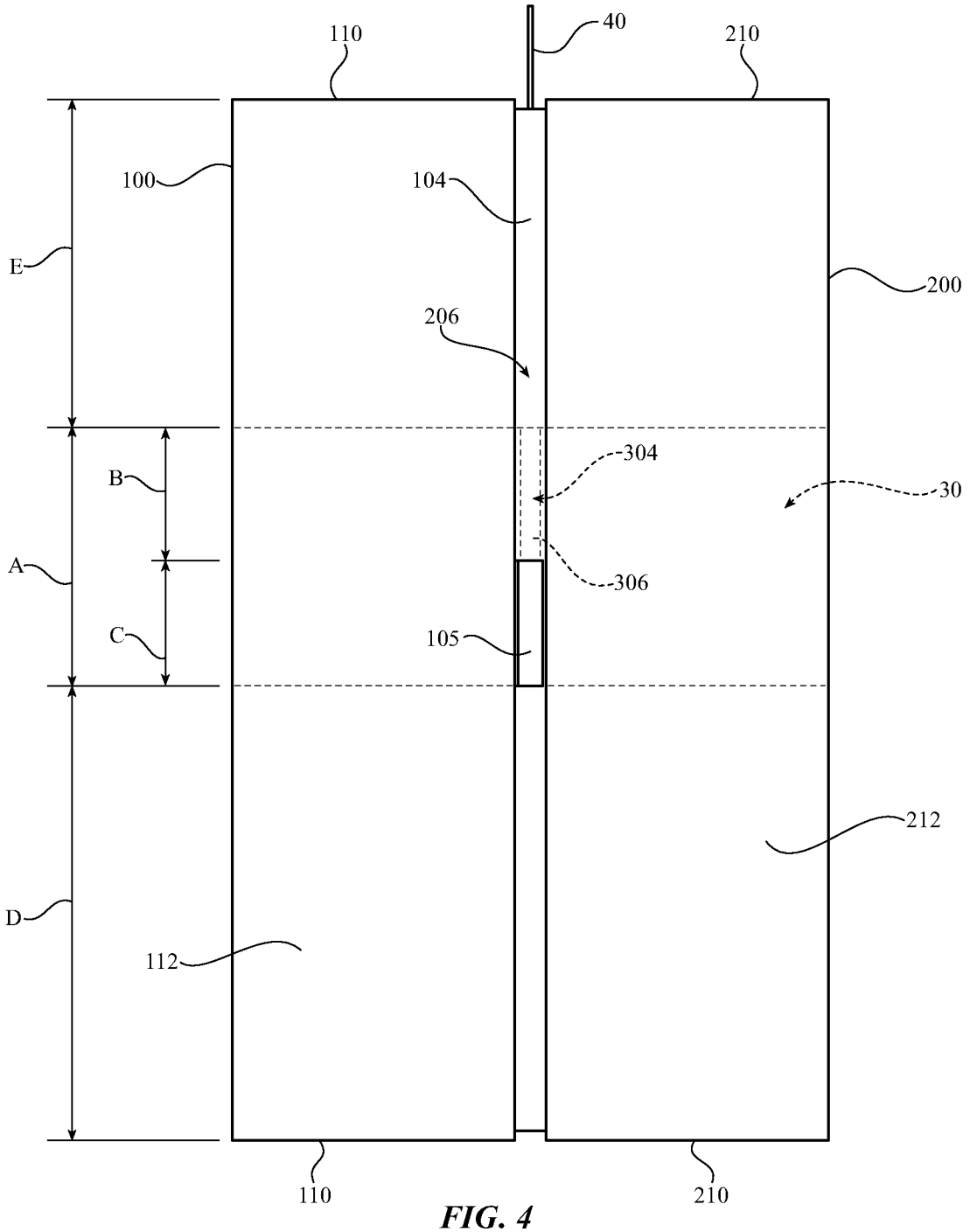
FIG. 4 shows a side view of the packaging shown in FIGS. 1-3, with the band removed.

In use, protrusion 306 may travel along channel 206, in a direction along the height of packaging 1, until it engages with a corresponding feature, e.g., a protrusion 105, formed as a stopper on front box 10 for example (see FIG. 4). Protrusion 105 may have a similar shape as protrusion 306. In some embodiments, protrusion 306 may have a square shape, a triangle shape, curved shape, etc., such that it is easily formed and fits within channel 206. In some embodiments, the protrusions may be adhered to band 30 or the front/rear boxes. In some embodiments, no adhesive is necessary to provide for the protrusions discussed herein. For example, protrusions may be formed from folds in band 30, front box 10, or rear box 20. In some embodiments, protrusions may be mechanically locked to one of the packaging 1's components without the use of adhesive.

In the figures, two protrusions 306 and two protrusions 105 are shown, however in practice fewer or additional protrusions may be included, provided that they are included as corresponding pairs. That is, a protrusion 306 should be matched with protrusion 105, such that band 30 maintains its position relative to front box 10 and rear box 20. By providing two protrusions 306 and two protrusions 105, as matching pairs, band 30 may be simply slid around packaging 1, without regard to orientation if desired, since the protrusions are on either side of band 30. The respective pairs of protrusions may have the same shape or different shapes. In some embodiments, the respective pairs of protrusions may have complimentary intersecting shapes, or complimentary connecting shapes (e.g., such that they may lock together and be unlocked via a user actuating a component).

In some embodiments, protrusion 306 or protrusion 305 may be formed as a detent, for example through embossing or debossing such as the deboss pattern 301, such that channel 206 may be omitted, while the consistent positioning of band 30 when packaging 1 is closed may be maintained. Other features such as debossing, embossing, texture, etc., may be provided to enhance the customer experience and function of disassembling packaging 1, e.g., when provided on band 30. Further, in some embodiments, the surface of band 30 may be configured in a way, such as debossing, so as to increase consumer comfort when removing band 30 from packaging 1 so as to open front box 10 and rear box 20.

As shown in FIGS. 2 and 3, the respective panels forming front box 10, rear box 20, and band 30, may allow front and rear panels 300 of band 30 to translate upwards along front and rear panels 100/200 of the front box 10 and rear box 20, respectively. Similarly side panels 312 of band 30 may translate along side panels 112/212 of front box 10 and rear box 20, respectively. In this way, the orientation packaging 1 may be maintained as the user removes band 30.

FIG. 4 shows a side view of the packaging shown in FIGS. 1-3, with the band removed, but shown generally via dotted lines in the figure. In use, protrusion 306 interfaces with protrusion 105, such that band 30 is held in a predetermined relative positioning along the height of packaging 1 via stopper 304 on band 30. In some embodiments, front box 10 may include inset panel 104, that may nest inside rear box 20. As shown, facing edges of side panels 112 and side panels 212 may be spaced apart such that inset panel 104 is visible when front box 10 and rear box 24 are coupled. Inset panel 104 thereby provides space for channel 206, such that band 30 including protrusion 306 may slide around packaging 1 when front box 10 and rear box 20 are coupled. The relationship between the height of the packaging, height of the band, and height of the protrusions along the height of the packaging is now described with reference to several dimensions shown in FIG. 4.

Dimension A is shown, and refers to band 30's height. Dimension B refers to stopper 304's and protrusion 306's height along packaging 1. Dimension C refers to protrusion 105's height along packaging 1. The intersection of B and C may vary from embodiment to embodiment. Dimension D refers to the height from the bottom panels 110/210 to where protrusion 105 begins, and Dimension E refers to the height between the upper edge of stopper 304 and protrusion 306 and the top panels 110/210 of packaging 1. Band 30 may have a height along the vertical axis of packaging 1, and the band's stopper 304 may be disposed closer to the top edge of band 30 such that when band 30 engages with front box 10 or rear box 20, stopper 304 is not visible. Protrusion 105 may be provided at least partially below the midpoint of the height of front box 10, such that band 30 may be centered on packaging 1 when it is closed.

Dimension A does not equal Dimension B plus Dimension C, in some embodiments. In some embodiments, however, Dimension A does equal Dimension B plus Dimension C, such that the band is the same height as the combined protrusions 105 and 306. In some embodiments, Dimension D is greater than Dimension E, is less than Dimension E, or is equal to Dimension E. In this way, depending on the desired form factor of packaging 1, and 30 may be consistently placed at a desired height while still maintaining structural integrity of the closed packaging 1, prior to a user desiring to separate front box 10 from rear box 20. Moreover, the starting points of C and B (i.e., ends closest to panels 110/210) may be shifted inward from the endpoints of A, such that the protrusions are recessed towards the center of band 30, thereby further hiding them during use. In such an example, Dimension B plus Dimension C equals less than Dimension A. In some embodiments, Dimension B and Dimension C are equal in some embodiments. In some embodiments, Dimension C can be made smaller to minimize its visual impact since it will be seen on the packaging 1 when band 30 is removed. In contrast, the protrusion of band 30 still will be hidden, because it is on an interior side of band 30.

As can be seen from FIG. 4, the protrusions of front box 10 and band 30 coact to fix a minimum vertical distance between the lower edge of the band and a bottom surface of the packaging. Band 30 is vertically supported in place by protrusion 306 resting on top of protrusion 105. In some embodiments, the minimum vertical distance between the lower edge of band 30 and a bottom surface of packaging 1 is less than 50% of the height of packaging 1. In some embodiments, the minimum vertical distance between the lower edge of band 30 and a bottom surface of packaging 1 is greater than 50% of the height of packaging 1. In some embodiments, the minimum vertical distance between the lower edge of band 30 and a bottom surface of packaging 1 is 50% of the height of packaging 1.

Figure 5:
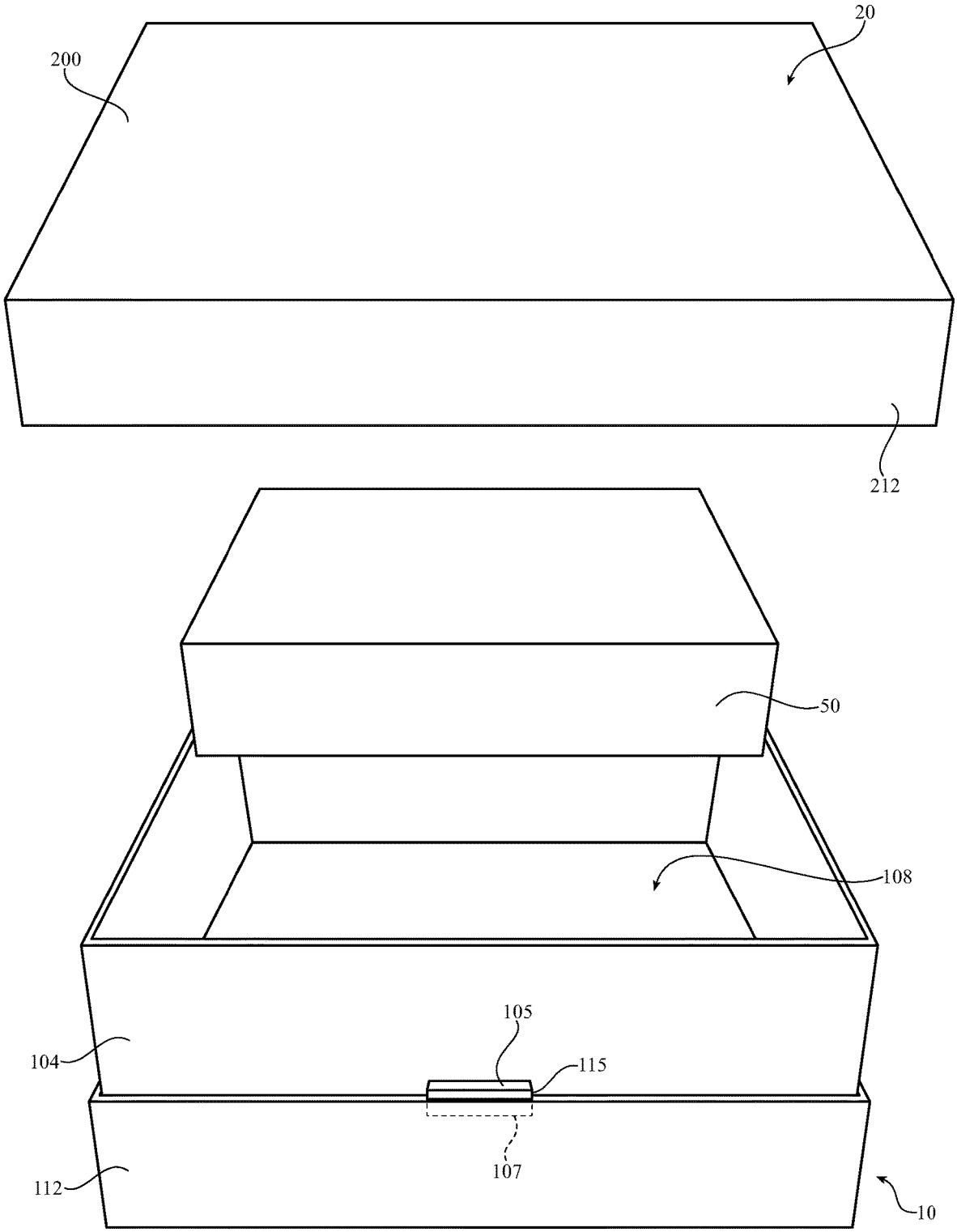
FIG. 5 shows an exploded view of the packaging shown in FIGS. 1-4, with the band removed and product visible.

FIG. 5 shows an exploded view of the packaging shown in FIGS. 1-4, with the band removed and product 50 visible. As shown front box 10 includes cavity 108 to receive product 50. In some embodiments, cavity 108 may include a raised platform that product 50 may rest on, such that product 50 may appear raised when product 50 is received within cavity 108. In some embodiments rear box 20 may serve as the receptacle for product 50. Inset panel 104 is shown, such that it is received by rear box 20 when packaging 1 is closed. As discussed above, protrusion 105 may be formed in front box 10, for example is a folded component having tab 107 sandwiched between inset panel 104 and side panel 112, for example between interface 115. This means that a folded protrusion may extend from an intersection of the side panel 112 and the inset panel 104. In some embodiments, protrusion 105 may be adhered to front box 10 at tab 107. In some embodiments, no adhesive is necessary to provide protrusion 105. For example, protrusion 105 may be formed from folds in front box 10, or rear box 20. In some embodiments, protrusions may be mechanically locked to one of the packaging 1's components without the use of adhesive.

While rear box 20 is shown as wholly separable from front box 10, in some embodiments rear box 20 may be joined to front box 10, e.g., at a foldable joint such that to open packaging 1 a user may lift and rotate rear box 20 (e.g., as a lid) to open to access a product, whereby the rear box 20 remains connected to front box 10.

Figure 6:
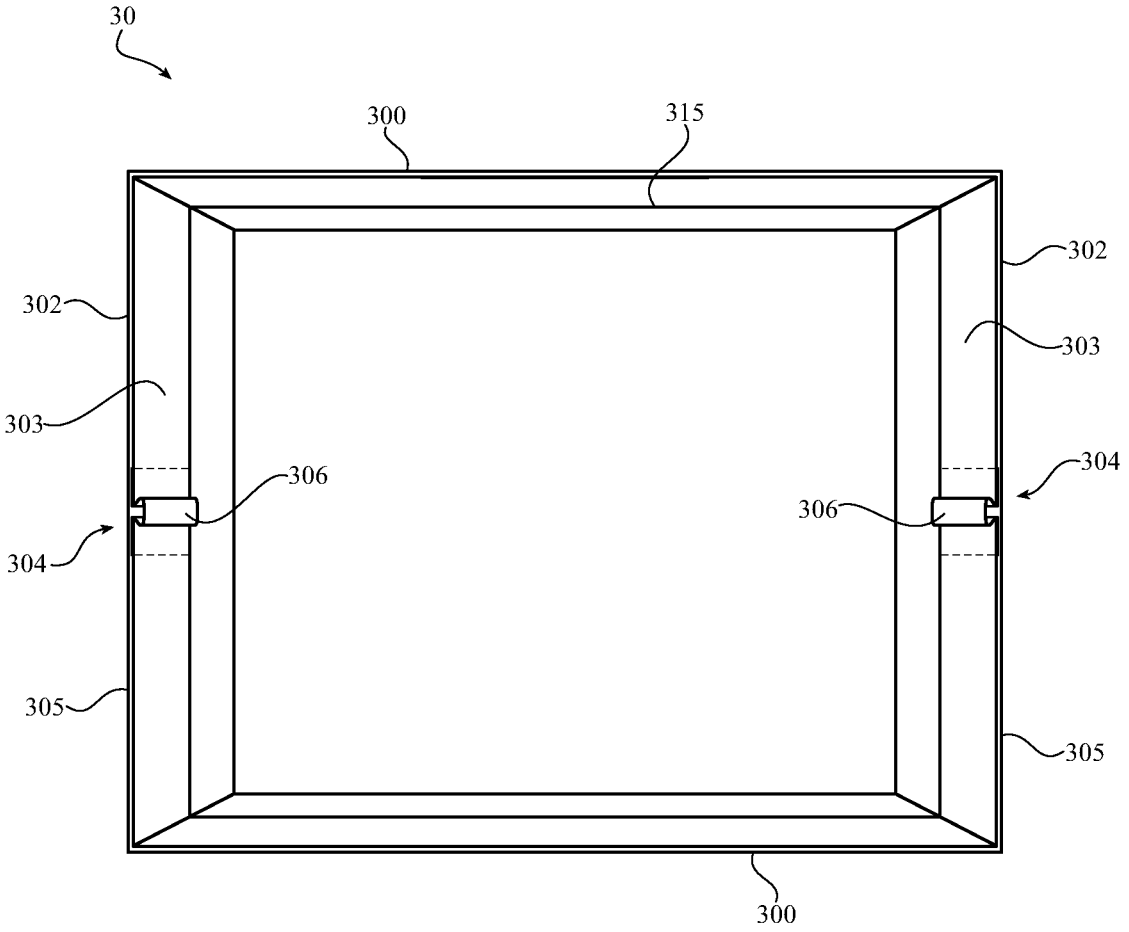
FIG. 6 shows a perspective view of the band shown in FIG. 1, when removed from the front box and rear box.

FIG. 6 shows a perspective view of band 30 shown in FIG. 1, when removed from front box 10 and rear box 20. As discussed above, the stoppers including protrusions 306 may be formed within band 30 via a first panel 305 and second panel 303. Second panel 303 may be integrally formed with first panel 305, folded in and meeting at seam 315. In some embodiments, the panels may be formed from separate layers, e.g., in multiple blanks.

As discussed herein, components of the packaging described may be formed from one or more blanks, e.g., cardboard or paper blanks. In some embodiments, the blank is formed of a single continuous substrate, such as, for example cellulose-based material like cardboard corrugate. Other cellulose-based materials are contemplated, such as paperboard, certain molded fiber components of sufficient construction, or grayboard. Tabs, flaps, and regions without adhesive of the blank are folded such that no adhesive is visible in finished packaging. In some embodiments, adhesive may be omitted and the various flaps and tabs attached in another suitable manner (e.g., by mechanical interlock or press fit).

As can be appreciated, the dimensions of the constituent panels and walls of the blank may be varied to accommodate different sizes and shapes of products or finished goods packaging, when the blank is folded into a configuration to receive such products or finished goods packaging. But while the dimensions and shapes may vary, the design may be scaled such that assembly is substantially the same, notwithstanding any dimensional differentiation.

Figure 7:
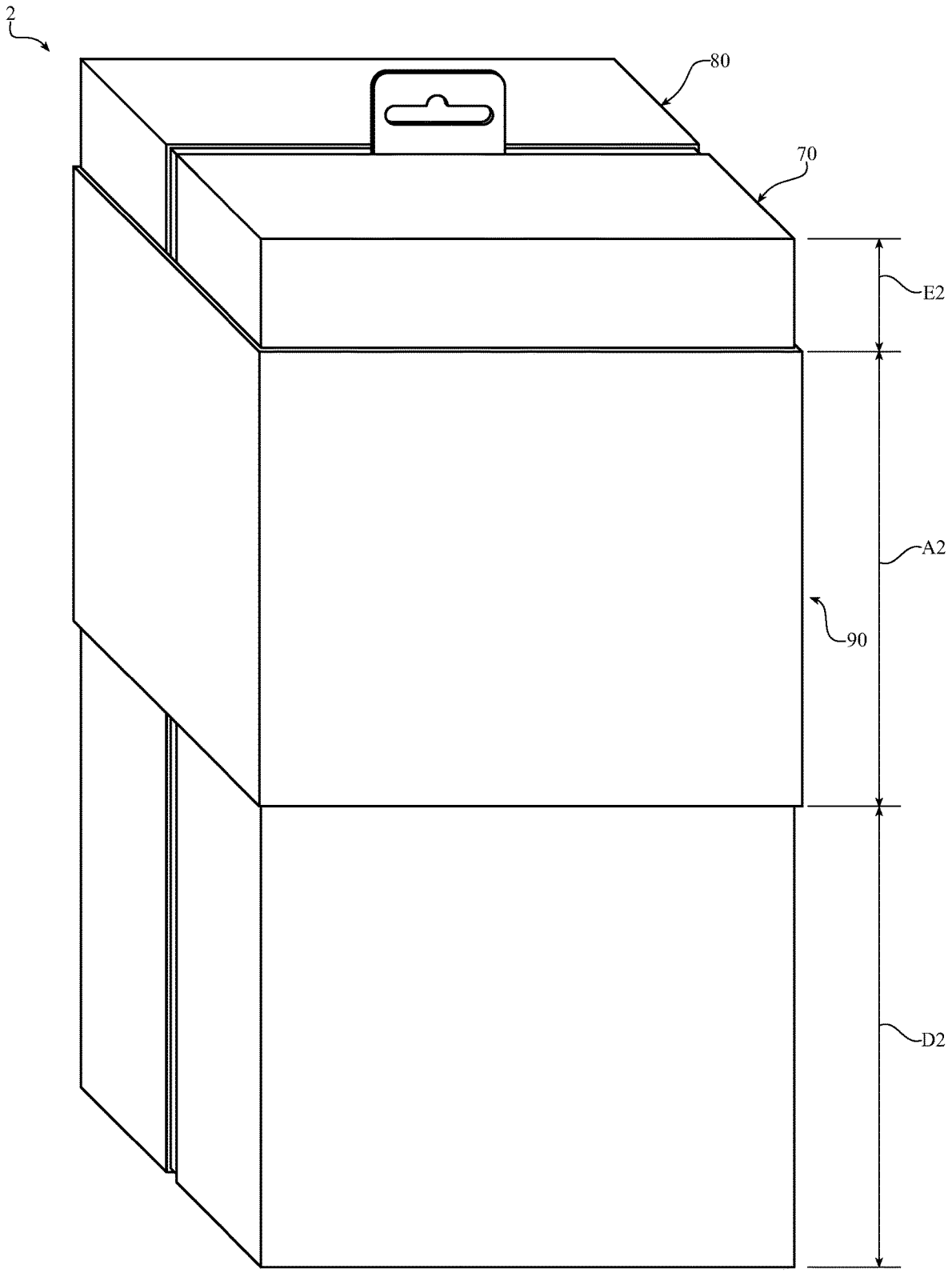
FIG. 7 shows a perspective view of packaging in an embodiment in a closed configuration and different dimensional characteristics from the packaging shown in FIG. 1.

FIG. 7 shows a perspective view of packaging 2 in an embodiment in a closed configuration and having different dimensional characteristics from the packaging shown in FIG. 1. Conceptually, packaging 2 is similar to packaging 1. Packaging 2 includes front box 70, rear box 80, and band 90. The illustration in FIG. 7 shows dimensions A2, D2, and E2, which are discussed with reference to the dimensions shown in FIG. 4. Dimension A2 is shown, and refers to band 90's height. Dimension D2 refers to the height from the bottom panels of packaging 2 to where band 90 begins, and Dimension E refers to the height between the upper edge of band 90 the top panels of packaging 2.

In the example of packaging 2 shown in FIG. 7, D2 is greater than D, such that the lower edge of band 90 is higher on packaging 2 than the lower edge of band 30 is on packaging 1. E2 in turn, is less than E, resulting in the top edge of band 90 being higher on packaging 2 than the top edge of band 30 is on packaging 1. A2 is greater than A, making band 90 taller than band 30. This results in a different appearance of band 90 floating around package 2, but the consistency of positioning between packaging 2 across other packaging 2 configured in the same manner remains due to the stoppers included in packaging 2 and configured in a similar manner as in packaging 1. Indeed, in some embodiments, band 30 may be used in packaging 2, provided that the perimeter created by front box 10 and rear box 80 is sufficiently similar to that created by front box 10 and front box 20. Features of packaging 1 as described herein may be applied to features of packaging 2 as described herein, without limitation, and vice versa.

Each of the components may be composed of recyclable materials including any shipping packaging, finished packaging, seals, and other related components. Thus, if and when the customer opts to dispose of the packaging, the packaging may simply be recycled without requiring material separation (e.g., in a single-stream recycling program). Advantageously, this improves upon prior systems having non-recyclable components, for example, polystyrene cushioning, or film wraps and/or bands.

Each of the components and their constituent parts, and other variations described herein may include corresponding features described with reference to each of the other components and features described without limitation.

In some embodiments, any surface finishing may take place after the components are cut from a blank, or alternatively prior to the blank being cut into separate sheets for assembling to a final product. Additionally, some operations may be performed concurrently. All or some of the surfaces of the packaging may be coated, or laminated, which may increase structural strength properties such as rigidity and which may protect a product within the packaging, or avoid scratching.

Additionally, the packaging may be manufactured in a cost-effective and environmentally-friendly way. In some embodiments, the packaging components may be constructed from a foldable material. In some embodiments, the foldable material may be a single piece of material that is cut by a single operation (e.g., a single die-cutting operation). In some embodiments, the foldable material may be die cut from a stock material (e.g., a sheet of cardboard corrugate, or roll of material), or other fiber or cellulose based material. Single integrally-formed pieces of material that are cut by a single cutting operation may facilitate efficient and reproducible manufacturing. Moreover, such manufacturing may reduce waste by reducing waste material during manufacturing.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of the specific embodiments described herein are presented for purposes of illustration and description. They are not target to be exhaustive or to limit the embodiments to the precise forms disclosed. It will be apparent to one of ordinary skill in the art that many modifications and variations are possible in view of the above teachings.

It is well understood that the use of personally identifiable information should follow privacy policies and practices that are generally recognized as meeting or exceeding industry or governmental requirements for maintaining the privacy of users. In particular, personally identifiable information data should be managed and handled so as to minimize risks of unintentional or unauthorized access or use, and the nature of authorized use should be clearly indicated to users.

What is claimed is:

1. Packaging, comprising:
a front box;
a rear box configured to close the front box and together enclose a product within the packaging; and
a band configured to slide around the front and rear box, thereby maintaining the front and rear box in a closed configuration, comprising:
a stopper configured to engage a feature of the front box or the rear box such that the travel of the band is limited along a vertical axis of the packaging, the stopper comprising a protrusion formed of paper.

2. The packaging of claim 1, wherein the protrusion is c-shaped, and is attached to the band via tabs attached to the band.

3. The packaging of claim 1, wherein together the front box and the rear box define a channel through which the protrusion translates when being slid around the front and rear box, thereby maintaining the orientation of the band.

4. The packaging of claim 1, wherein the front box comprises the feature that engages the stopper, and wherein the feature is a protrusion formed of paper and is covered by the band.

5. The packaging of claim 1, wherein the band has a height along the vertical axis of the packaging, wherein the stopper is disposed closer to the top edge of the band than it is to the bottom edge of the band such that when the band engages with the feature of the front box or the rear box, the stopper is not visible.

6. The packaging of claim 1, wherein the front box comprises the feature that engages the stopper, and wherein the feature is a protrusion beginning below the midpoint of the height of the front box, such that the band is centered on the packaging when the packaging is closed and the stopper is in contact with the feature.

7. The packaging of claim 1, wherein the stopper comprises a c-shaped protrusion formed of paper.

8. The packaging of claim 1, wherein the stopper comprises a detent formed from the band and engages a corresponding feature on the packaging.

9. A packaged product, comprising: the packaging of claim 1; and
a product disposed within the packaging, wherein the product is an electronic device.

10. Packaging, comprising:
a box, comprising:
side panels;
top and bottom panels; and
an inset panel providing space for a channel when the box is closed; and
a band, comprising:
a stopper configured to engage a feature within the channel such that travel of the band is limited along a vertical axis of the packaging.

11. The packaging of claim 10, wherein the box comprises a lid.

12. The packaging of claim 10, wherein the feature within the channel comprises a protrusion formed from paper.

13. The packaging of claim 10, wherein the feature within the channel releasably locks with the stopper.

14. The packaging of claim 13, wherein the band is configured such that a user may actuate the band to unlock the feature and remove the band from the packaging.

15. A packaged product, comprising:
the packaging of claim 10; and
a product, wherein the product is an electronic device.

16. Packaging, comprising:
a front box, comprising:
a front panel;
a side panel;
an inset panel disposed inward from the side panel and extending in a direction away from the front panel; and
a folded protrusion extending from an intersection of the side panel and the inset panel;
a rear box configured to close the front box by receiving the inset panel in a cavity, wherein the inset panel forms an exterior channel between the front box and the rear box when the packaging is closed; and
a band formed and configured to slide around the front and rear box, comprising:
a folded protrusion configured to engage the folded protrusion of the front box when the band is slid around the front and rear box, thereby fixing a minimum vertical distance between the lower edge of the band and a bottom surface of the packaging.

17. The packaging of claim 16, wherein the minimum vertical distance between the lower edge of the band and a bottom surface of the packaging is less than 50% of the height of the packaging.

18. The packaging of claim 16, wherein the minimum vertical distance between the lower edge of the band and a bottom surface of the packaging is greater than 50% of the height of the packaging.

19. The packaging of claim 16, wherein the minimum vertical distance between the lower edge of the band and a bottom surface of the packaging is 50% of the height of the packaging.

20. Packaging, comprising:

a front box;

a rear box configured to close the front box and together enclose a product within the packaging; and a band configured to slide around the front and rear box, thereby maintaining the front and rear box in a closed configuration, comprising:

a c-shaped paper protrusion configured as a stopper configured to engage a feature of the front box or the rear box such that the travel of the band is limited along a vertical axis of the packaging.

* * * * *